US009845738B2

(12) United States Patent
Pluta

(10) Patent No.: US 9,845,738 B2
(45) Date of Patent: Dec. 19, 2017

(54) VARIABLE COMPRESSION RATIO PISTON SYSTEM

(71) Applicant: BorgWarner Inc., Auburn Hills, MI (US)

(72) Inventor: Christopher J. Pluta, Lansing, NY (US)

(73) Assignee: BorgWarner Inc., Auburn Hills, MI (US)

( * ) Notice: Subject to any disclaimer, the term of this patent is extended or adjusted under 35 U.S.C. 154(b) by 220 days.

(21) Appl. No.: 14/653,367

(22) PCT Filed: Dec. 4, 2013

(86) PCT No.: PCT/US2013/073023

§ 371 (c)(1),
(2) Date: Jun. 18, 2015

(87) PCT Pub. No.: WO2014/099374

PCT Pub. Date: Jun. 26, 2014

(65) Prior Publication Data

US 2015/0300272 A1 Oct. 22, 2015

Related U.S. Application Data

(60) Provisional application No. 61/740,484, filed on Dec. 21, 2012.

(51) Int. Cl.
*F02D 15/02* (2006.01)
*F02B 75/04* (2006.01)

(52) U.S. Cl.
CPC ..... *F02D 15/02* (2013.01); *F02B 75/04* (2013.01); *F02B 75/045* (2013.01)

(58) Field of Classification Search
CPC ..... F02B 75/045; F02B 75/04; F02D 15/02; F02D 15/04
See application file for complete search history.

(56) References Cited

U.S. PATENT DOCUMENTS 1,747,091 A * 2/1930 Trbojevich ..... F02B 75/045 123/78 E
4,124,002 A * 11/1978 Crise ..... F16C 7/04 123/78 E (Continued)

FOREIGN PATENT DOCUMENTS

DE 102010061359 * 6/2012 ..... F02B 75/045
JP 03-205298 9/1991
JP 2007247527 9/2007

OTHER PUBLICATIONS

International Search Report for PCT/US2013/073023 dated Mar. 17, 2014; 10 pages.

*Primary Examiner* — Lindsay Low
*Assistant Examiner* — Kevin A Lathers
(74) *Attorney, Agent, or Firm* — Brown & Michaels, PC

(57) ABSTRACT

The variable compression ratio piston system for an engine adjusts the compression ratio of the engine piston by way of hydraulic fluid distributed between a pair of chambers formed in a pair of bores receiving control pistons mechanically coupled to the engine piston. A control valve selectively permits flow of hydraulic fluid between the high compression ratio line and the low compression ratio line. A variable force solenoid controlled by an engine control unit preferably controls the position of the control valve. The position of the spool controls whether hydraulic fluid can flow toward the first chamber, toward the second chamber, or not at all. Flow of hydraulic fluid is actuated by alternating forces from inertial and combustion forces on a crankshaft from operation of the engine.

23 Claims, 12 Drawing Sheets

(56) References Cited

U.S. PATENT DOCUMENTS

| | | | | |
|---|---|---|---|---|
| 4,195,601 | A * | 4/1980 | Crise | F02B 75/045 123/48 B |
| 5,172,659 | A | 12/1992 | Butterfield | |
| 6,354,252 | B1 | 3/2002 | Rabhi | |
| 7,000,580 | B1 | 2/2006 | Smith et al. | |
| 7,059,280 | B2 | 6/2006 | Nohara et al. | |
| 8,875,671 | B2 * | 11/2014 | Vianney | F02B 75/045 123/197.1 |
| 2004/0025814 | A1 * | 2/2004 | Gray, Jr. | F02B 75/045 123/48 B |
| 2004/0182344 | A1 | 9/2004 | Simpson et al. | |
| 2005/0028762 | A1 * | 2/2005 | Shiraishi | F02B 75/048 123/78 E |
| 2009/0320803 | A1 | 12/2009 | Simpson | |
| 2010/0163003 | A1 | 7/2010 | Rabhi | |
| 2017/0022895 | A1 * | 1/2017 | Balling | F16K 27/041 |
| 2017/0082021 | A1 * | 3/2017 | Schaffrath | F02D 15/02 |

* cited by examiner

VARIABLE COMPRESSION RATIO PISTON SYSTEM

BACKGROUND OF THE INVENTION

Field of the Invention

The invention pertains to the field of variable compression ratio systems. More particularly, the invention pertains to a variable compression ratio piston system for an engine.

Description of Related Art

Variable compression ratio (VCR) systems are known in the art. A compression ratio, as used herein, is the ratio of the volume of the cylinder chamber, or combustion chamber in the case of an engine, at its largest capacity to the volume at its smallest capacity. VCR systems for internal combustion engines are intended to be able to change the compression ratios of the pistons in their respective engine cylinders on the fly. This allows for increased fuel efficiency by varying the compression ratios in response to varying loads on the engine during operation. While VCR engine research goes back several decades and many automobile manufacturers are currently working on VCR engine designs, no current commercially-available automobiles have a VCR engine. The mechanical complexity and difficulty in controlling the system parameters to provide the desired improvement have thus far prevented commercialization of this technology in automobiles.

U.S. Pat. App. Pub. No. 2010/0163003, entitled "Electro-hydraulic Device for Closed-Loop Driving the Control Jack of a Variable Compression Ratio Engine" by Rabhi and published Jul. 1, 2010, discloses an electrohydraulic device for controlling the compression ratio of a variable compression-ratio engine. In a first embodiment, two electrovalves are provided per control jack at an inlet and an outlet, each electrovalve being furnished with a check valve. In a second embodiment, a single electrovalve is provided and includes an electrically-controlled spool with two inlets and two outlets. In a third embodiment, a single two-way electrovalve is provided. The electrovalve is capable of opening and closing sufficiently rapidly to allow the movement of the control rack only for a few degrees of angular movement of the crankshaft. It should be noted that one of the positions seems to allow recirculation between the upper chamber and the lower chamber of the control jack.

U.S. Pat. App. Pub. No 2009/0320803, entitled "Control Method for a Variable Compression Actuator System" by Simpson and published Dec. 31, 2009, discloses a control system for an adjustment device for a variable compression ratio engine comprising: a jack head, a jack piston, a sprocket wheel, a movable transmission member, and a control valve. The jack piston is received within a chamber of the jack head defining first and second fluid chambers. The control valve controls the flow of fluid between the first and second fluid chambers. Based on the position of the control valve, fluid flows from the first fluid chamber to the second fluid chamber or vice versa, moving the control rack connecting the jack piston to the sprocket wheel. Reciprocating motion of the sprocket wheel adjusts the position of the cylinder of the engine.

The above-mentioned references are hereby incorporated by reference herein.

FEV, Inc. (Auburn Hills, Mich.) manufactures a two-step variable compression ratio (VCR) system. The FEV-developed 2-step VCR mechanism induces small variations in the rod length that are achieved by using the gas and mass forces for actuation. A compression ratio that is variable in two steps from 14:1-17:1 in the case of a commercial diesel version is thereby achieved. This ensures rapid and accurate actuation without the use of an expensive power actuator. Versions of the system are available for both gasoline and diesel engines and can be applied to almost all existing engines with bore diameters as low as 70 mm. In addition to increased engine efficiency, the system also offers emissions-related benefits, depending on whether applied to gasoline or diesel engines. Other potential benefits include improved cold startability and the potential to optimize performance while utilizing alternative fuels. The system can be integrated into existing engine designs due to a carry-over piston and pin design.

SUMMARY OF THE INVENTION

The variable compression ratio piston system for an engine adjusts the compression ratio of the engine piston by way of hydraulic fluid distributed between a pair of chambers formed in a pair of bores receiving control pistons mechanically coupled to the engine piston. A control valve selectively permits flow of hydraulic fluid between the high compression ratio line and the low compression ratio line. A variable force solenoid controlled by an engine control unit preferably controls the position of the control valve. The position of the control valve controls whether hydraulic fluid can flow toward the first chamber, toward the second chamber, or not at all. Flow of hydraulic fluid is actuated by alternating forces from inertial and combustion forces on a crankshaft from operation of the engine.

A variable compression ratio piston system includes at least one engine piston assembly. Each engine piston assembly includes an engine piston, a first control piston, a second control piston, a high compression ratio line, and a low compression ratio line. The variable compression ratio piston system also includes a control system. The engine piston is slidingly received in an engine cylinder of an engine. The first control piston is mechanically coupled to the engine piston and actuates in a first control piston bore. The first control piston and the first control piston bore define a first chamber. The second control piston is mechanically coupled to the engine piston and actuates in a second control piston bore. The second control piston and the second control piston bore define a second chamber. The low compression ratio line supplies hydraulic fluid to the first chamber and drains hydraulic fluid from the first chamber. The high compression ratio line supplies hydraulic fluid to the second chamber and drains hydraulic fluid from the second chamber. The control system includes at least one control valve and selectively permits flow of hydraulic fluid between the low compression ratio line and the high compression ratio line.

When the control valve is in a first position, a first net flow of hydraulic fluid from the second chamber to the first chamber by way of the high compression line, the control valve, and the low compression line is permitted such that the first net flow raises the first control piston in the first control piston bore and lowers the second control piston in the second control bore to lower the engine piston, thereby decreasing a compression ratio of the engine piston toward a low compression ratio state. When the control valve is in a second position, a second net flow of hydraulic fluid from the first chamber to the second chamber by way of the low compression line, the control valve, and the high compression line is permitted such that the second net flow raises the second control piston in the second control piston bore and lowers the first control piston in the first control bore to raise the engine piston, thereby increasing the compression ratio of the engine piston toward a high compression ratio state.

A method of varying a compression ratio of at least one engine piston received in an engine cylinder of an engine includes measuring a load on the engine, calculating a compression ratio state for the at least one engine piston based on the load on the engine, adjusting the control valve to permit the variable compression ratio piston system to move toward the compression ratio state, and adjusting the control valve to a third position when the variable compression ratio piston system reaches the compression ratio state. The variable compression ratio piston system further includes a first control piston mechanically coupled to the engine piston and actuates in a first control piston bore. The first control piston and the first control piston bore define a first chamber. A second control piston mechanically coupled to the engine piston actuates in a second control piston bore. The second control piston and the second control piston bore define a second chamber. A low compression ratio line supplies hydraulic fluid to the first chamber and drains hydraulic fluid from the first chamber, and a high compression ratio line supplies hydraulic fluid to the second chamber and drains hydraulic fluid from the second chamber. A control system includes the control valve and selectively permits flow of hydraulic fluid between the low compression ratio line and the high compression ratio line. When the control valve is in a third position, the control system prevent flow of hydraulic fluid between the first chamber and the second chamber by way of the low compression line, the control valve, and the high compression line, thereby maintaining the compression ratio of the engine piston.

DETAILED DESCRIPTION OF THE INVENTION

Figure 1A:
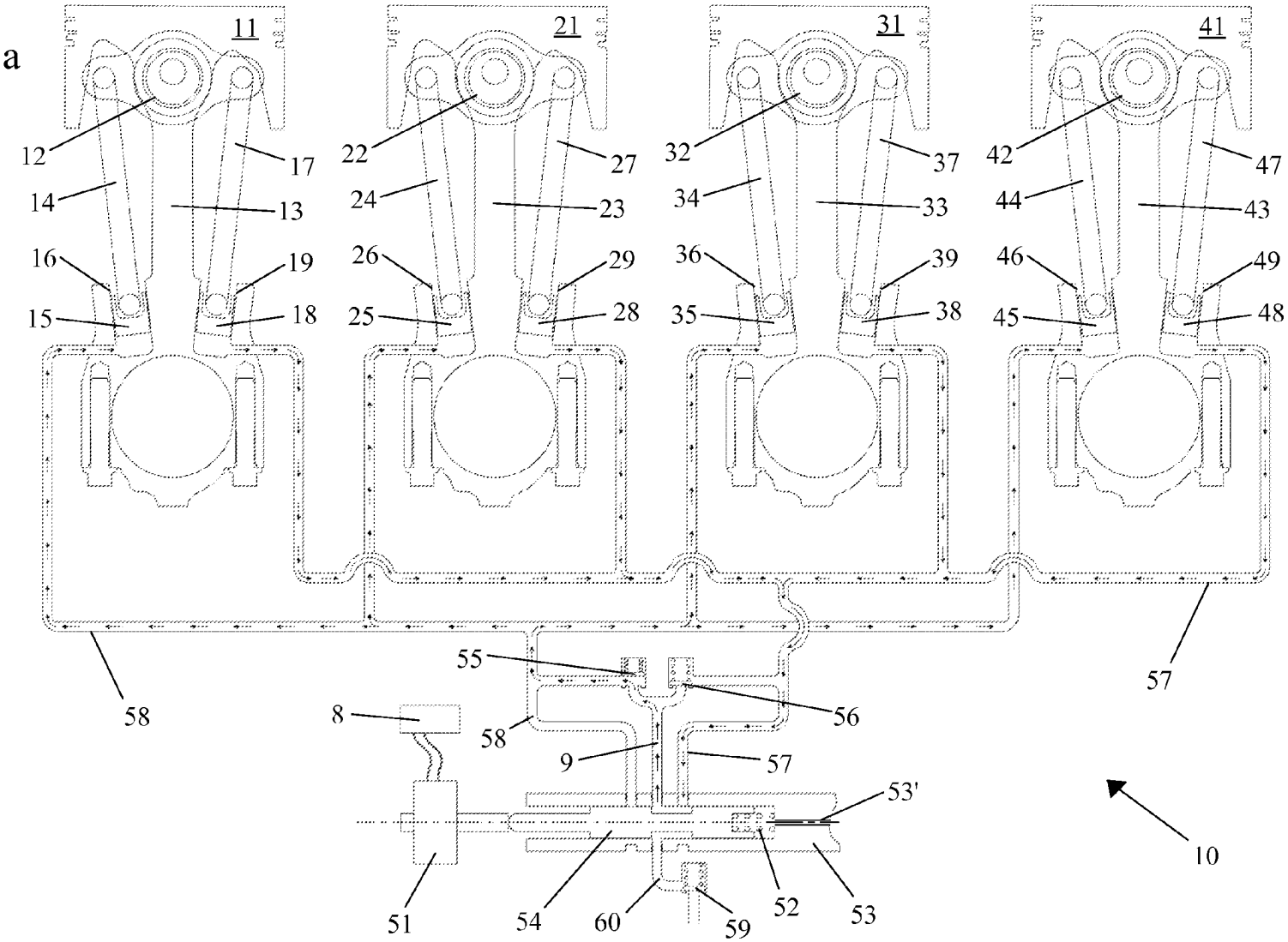
FIG. 1*a* shows a schematic of a two-position compression ratio system of a first embodiment with a control system in a first position.

Hydraulic systems allow the compression ratio of an internal combustion engine to be varied. More specifically, a spool valve is hydraulically coupled to control piston chambers and fluid is exhausted or supplied through recirculation to these chambers as needed to alter the compression ratio. The systems use a mechanical mechanism to capture alternating forces on a connecting rod to move a piston. The alternating forces are a result of inertial and combustion forces on the crankshaft. An eccentric bearing/pivot at the top of the piston is connected to a mechanical linkage that allows the piston to move up or down. The rods from the linkage extend from the top of the piston to the bottom on both sides of the connecting rod. A control piston at the bottom of each rod rides inside a bore in the connecting rod body. Oil is supplied to the hydraulic passages at the bottom of the control piston bores by the control valve and check valves.

The hydraulics operate similarly to a cam torque actuated (CTA) phaser used to adjust the relative angular position of a camshaft to a crankshaft or another camshaft; the energy from the alternating forces is used to actuate the piston/linkage up and down, thereby changing the overall piston height. The alternating forces for this particular system come from inertial and combustion forces on the crankshaft. The oil in the system is controllably re-circulated back and forth between the two control pistons through the use of check valves and a control valve. Because the system is able to recirculate the oil between the control piston chambers, the oil consumption of the system is reduced compared to a conventional variable compression ratio system using oil pressure to raise or lower the control pistons, which in turn raise or lower the piston changing the compression ratio. In order to move the control pistons in the conventional system, the oil in one of the control piston chambers, depending on the direction of change, needs to be exhausted to the crank case/reservoir, while oil from crank case/reservoir is being pumped into the opposite chamber.

An actuator controls the position of the control valve. The actuator may be a variable force solenoid (VFS), a differential pressure control system (DPCS), regulated pressure control system (RPCS), a stepper motor, an air actuator, a vacuum actuator, a hydraulic actuator, or any other type of actuator that has force or position control. In some embodiments, the VFS is positioned in front of the control valve and moves the valve as current is applied to the VFS. In some embodiments, the control valve is a spool valve. In some embodiments, the control valve is a check valve in spool. On the opposite side of the spool is a spring, which constantly provides a counter force to the VFS and pushes the spool to a base position, when the current to the VFS is reduced to be lower than the spring force. The position of the control valve determines the position of the piston (i.e., low or high compression). Several different configurations may be used within the spirit of the present invention. In some embodiments, a DPCS uses differential oil pressure on opposite ends of the spool to control the control valve position, while a pair of opposing springs biases the spool and the piston toward each other. In other embodiments, an RPCS uses oil pressure on one end opposed by a spring on the other end to control the control valve position.

In a two-position system, one position produces a high compression ratio state and a second position produces a low compression ratio state. Alternatively, the positions may be flipped such that position one is low compression and position two is high compression, depending on strategy. In some two-position systems, there is one control valve, one control valve spring, two high pressure check valves, one supply check valve, and one VFS. A mechanical linkage system connects every piston. In position one, the default position, the control valve is fully extended outward with a minimum load on the control valve spring, and the VFS is fully retracted. Depending on the original equipment manufacturer (OEM) strategy, this is either the high or low compression state. Once current is applied to the VFS, the VFS pushes the control valve in to the second position, thereby changing the flow path in the hydraulic circuit, which causes the piston to move into the opposite position. In some embodiments, the two-position system includes bias springs. In some embodiments, the bias springs bias the system toward a low compression ratio state when the system is under low torsional energy. In other embodiments, the bias springs bias the system toward a high compression ratio state when the system is under low torsional energy.

In a variable position system, each piston on the engine has its own control system, including a control valve, a control valve spring, two high-pressure check valves, a supply check valve, a VFS, a mechanical linkage system, and a combustion sensor. With each piston having its own control system the compression ratio may be varied to any value within the mechanical range of the linkage. In order to accurately predict the movement of the mechanism, a combustion sensor is used in each cylinder to keep it properly controlled. The sensor allows each individual piston in the system to be set to a specific compression value, thereby helping to compensate for stack-ups or manufacturing defects that might result in a cylinder-to-cylinder structural difference.

In some embodiments, the variable position system includes a biasing spring added between the control piston and control piston bore to push the linkage to a default or start-up position or to balance the mean torque of the system.

FIG. 1*a* shows a four-cylinder, two-position variable compression ratio system 10 with a control system in a first position. Each piston includes an engine piston 11, 21, 31, 41 rotatably connected to an eccentric bearing 12, 22, 32, 42, and a connecting rod 13, 23, 33, 43, a first linking rod 14, 24, 34, 44 coupling the engine piston to a first control piston 15, 25, 35, 45, which is slidingly received in a first control piston bore 16, 26, 36, 46, and a second linking rod 17, 27, 37, 47 coupling the engine piston to a second control piston 18, 28, 38, 48, which is slidingly received in a second control piston bore 19, 29, 39, 49. The engine pistons actuate in engine cylinders (not shown).

The compression ratios of the engine pistons 11, 21, 31, 41 are simultaneously controlled by a single control system. An actuator 51, in combination with a control valve spring 52, controls the position of a spool 54 in a control valve bore of the control valve 53. A vent 53' through the control valve body to the atmosphere minimizes air pressure fluctuations in the back end of the spool valve bore when the spool 54 moves back and forth in the spool valve bore. An engine control unit (ECU) 8 controls the actuator 51. When the actuator 51 is a variable force solenoid, an engine control unit (ECU) 8 energizes the variable force solenoid 51 to control the position of the spool 54 within the control valve 53. The spool 54 of the control valve 53 is shown in a first position in FIG. 1*a*. With the control valve 53 in the first position, the spool 54 connects the high compression ratio lines 57 to the central line 9 while a first land of the spool 54 blocks the low compression ratio lines 58 from the central line 9. The first high-pressure check valve 55 permits flow of hydraulic fluid from the central line 9 to the low compression ratio lines 58 as indicated by the arrows, while the second high-pressure check valve 56 and the spool 54 prevent flow of hydraulic fluid to the high compression ratio lines 57 and from the low compression ratio lines 58, respectively. This circuit achieves the net effect of decreasing the amount of hydraulic fluid in the chambers formed by the second control pistons 18, 28, 38, 48 and increasing the amount of hydraulic fluid in the chambers formed by the first control pistons 15, 25, 35, 45, thereby moving the control pistons and the engine pistons 11, 21, 31, 41 toward a low compression ratio position. A supply check valve 59 in a supply line 60 permits flow of hydraulic fluid into the system and prevents flow of the hydraulic fluid back to a hydraulic fluid source to maintain hydraulic pressure in the system.

Figure 1B:
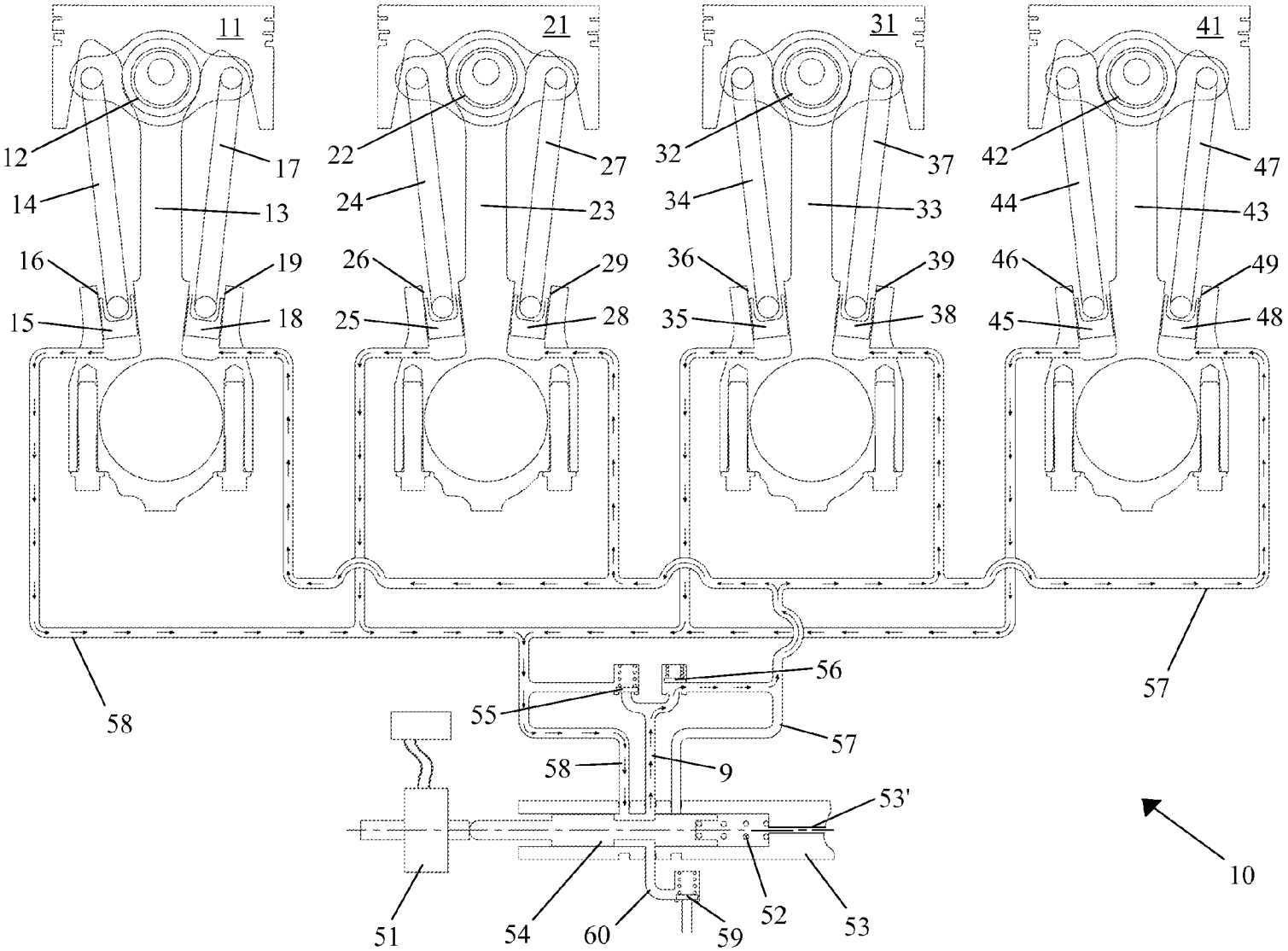
FIG. 1*b* shows a schematic of the system of FIG. 1*a* with the control system in a second position.

FIG. 1*b* shows the four-cylinder, two-position compression ratio system 10 of FIG. 1*a* with the control system in a second position. The spool 54 of the control valve 53 is shown in a first position in FIG. 1*a*. With the control valve 53 in the second position, the spool 54 connects the low compression ratio lines 58 to the central line 9 while a second land of the spool 54 blocks the high compression ratio lines 57 from the central line 9. The second high-pressure check valve 56 permits flow of hydraulic fluid from the central line 9 to the high compression ratio lines 57 as indicated by the arrows, while the first high-pressure check valve 55 and the spool 54 prevent flow of hydraulic fluid to the low compression ratio lines 58 and from the high compression ratio lines 57, respectively. This circuit achieves the net effect of decreasing the amount of hydraulic fluid in the chambers formed by the first control pistons 15, 25, 35, 45 and increasing the amount of hydraulic fluid in the chambers formed by the second control pistons 18, 28, 38, 48, thereby moving the control pistons and the engine pistons 11, 21, 31, 41 toward a high compression ratio position. This is also the default position of the spool 54 when the VFS 51 is not energized.

Figure 2:
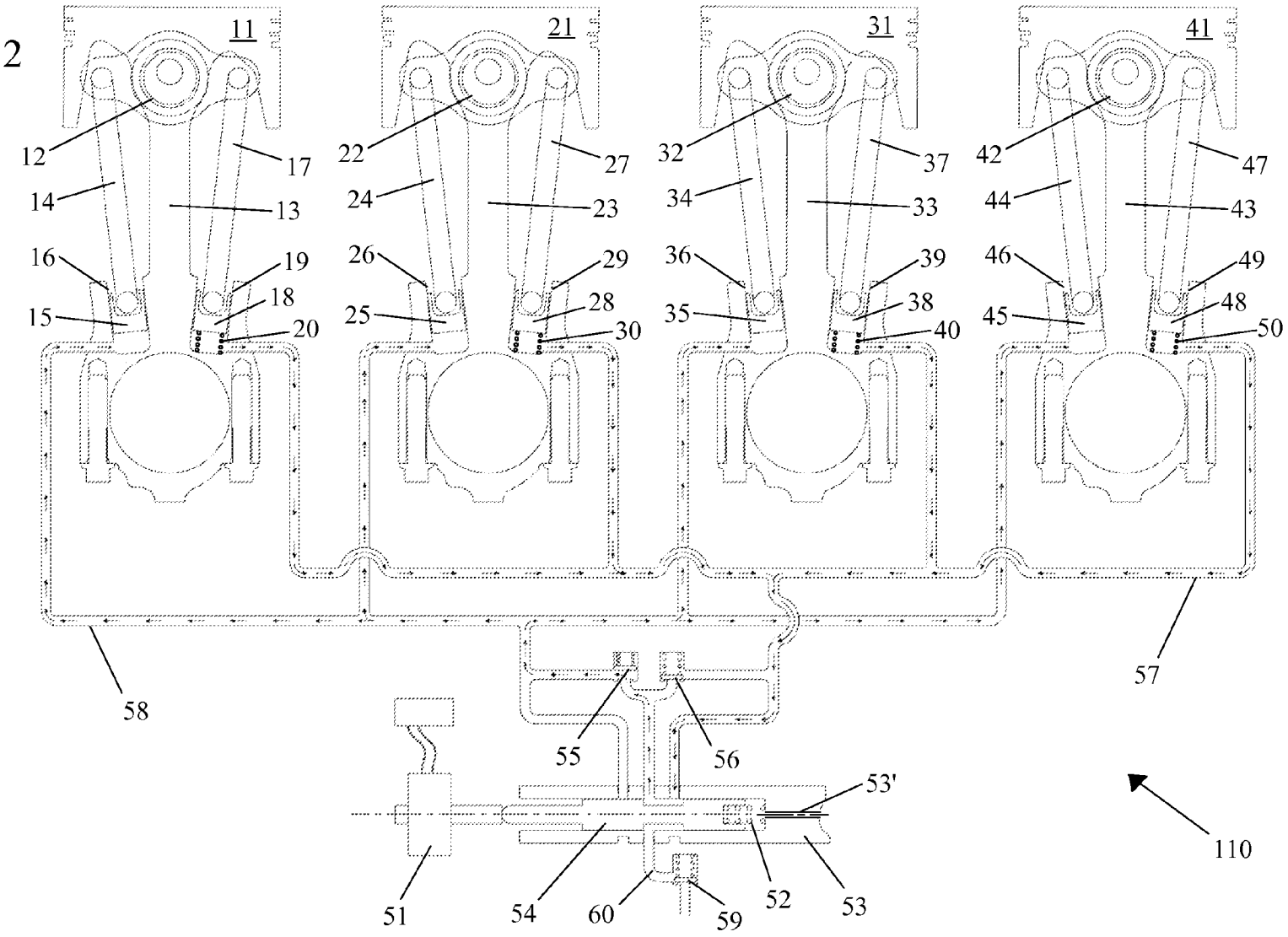
FIG. 2 shows a schematic of a two-position compression ratio system of a second embodiment with a control system in a first position and with bias springs.

FIG. 2 shows a four-cylinder, two-position variable compression ratio system 110 with a control system in a first position. The system of FIG. 2 operates similarly to the system of FIG. 1*a* and FIG. 1*b*, except that in this system, the second control piston 18, 28, 38, 48 is biased upward by a control piston bias spring 20, 30, 40, 50. The control piston bias springs 20, 30, 40, 50 on the second control pistons 18, 28, 38, 48 bias the engine pistons 11, 21, 31, 41 toward a high compression ratio state.

Figure 3:
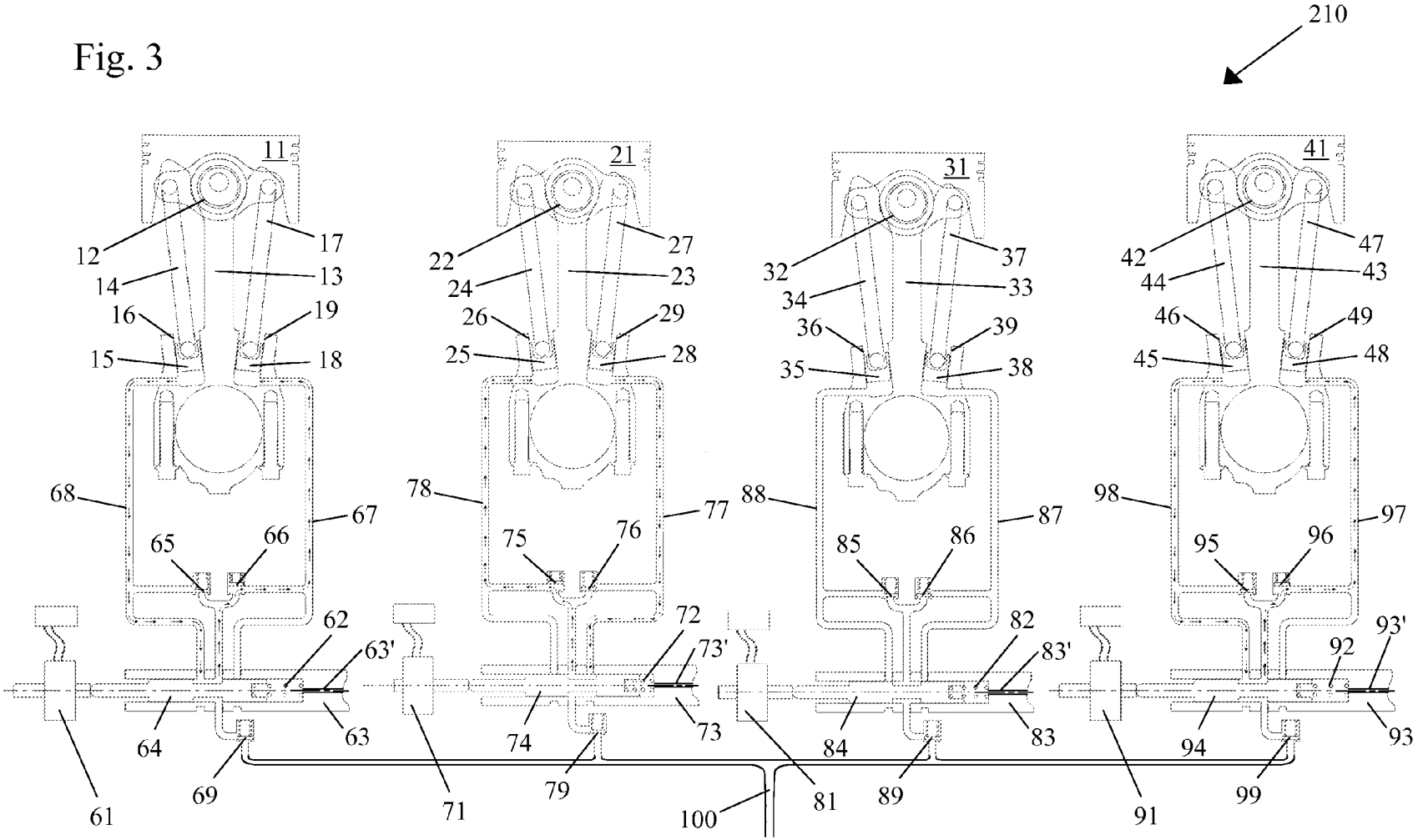
FIG. 3 shows a schematic of a variable compression ratio system in a first embodiment.

FIG. 3 shows a four-cylinder variable compression ratio system 210 with a separate control system for each of the four pistons 11, 21, 31, 41. As in the system of FIG. 1*a* and FIG. 1*b*, each piston includes an engine piston 11, 21, 31, 41 rotatably connected to an eccentric bearing 12, 22, 32, 42, and a connecting rod 13, 23, 33, 43, a first linking rod 14, 24, 34, 44 coupling the engine piston to a first control piston 15, 25, 35, 45, which is slidingly received in a first control piston bore 16, 26, 36, 46, and a second linking rod 17, 27, 37, 47 coupling the engine piston to a second control piston 18, 28, 38, 48, which is slidingly received in a second control piston bore 19, 29, 39, 49.

The compression ratios of the engine pistons 11, 21, 31, 41 are independently controlled by separate control systems. For each piston, an actuator 61, 71, 81, 91 in combination with a control valve spring 62, 72, 82, 92, controls the position of the control valve 63, 73, 83, 93. A vent 63', 73', 83', 93' through each control valve body to the atmosphere minimizes air pressure fluctuations in the back end of the spool valve bore when the spool 64, 74, 84, 94, respectively, moves back and forth in the spool valve bore. A single engine control unit preferably controls all of the actuators 61, 71, 81, 91, although a separate engine control unit for each actuator may be used within the spirit of the present invention. The spool 74 of the control valve for the second engine piston 21 is shown in a first position. The spools 64, 94 for the control valves for the first engine piston 11 and the fourth engine piston 41, respectively, are shown in a second position. The spool 84 of the control valve for the third engine piston 31 is shown in a third position.

With the control valve 73 in the first position, the high-pressure check valves 75, 76 permit flow of hydraulic fluid in the direction indicated by the arrows from the chamber formed by the second control piston 28 to the chambers formed by the first control piston 25 by way of the high compression ratio lines 77 and the low compression ratio lines 78 toward a low compression position. With the control valves 64, 94 in the second position, the high-pressure check valves 65, 66, 95, 96 permit flow of hydraulic fluid in the direction indicated by the arrows from the chamber formed by the first control pistons 15, 45 to the chambers formed by the second control pistons 18, 48 by way of the high compression ratio lines 67, 97 and the low compression ratio lines 68, 98 toward a high compression position. With the control valve 84 in the third position, the control valve 84 and the high-pressure check valves 85, 86 prevent flow of hydraulic fluid between the chamber formed by the first control piston 35 and the chambers formed by the second control piston 38 by way of the high compression ratio line 87 and the low compression ratio line 88 to maintain the current compression position. Supply check valves 69, 79, 89, 99 in a supply line 100 permits flow of hydraulic fluid into the system and prevents flow of the hydraulic fluid back to the hydraulic fluid source to maintain hydraulic pressure in the system. In this system, each control system has its own individual supply check valve 69, 79, 89, 99, but alternatively, a single supply check valve could be used upstream for all four control systems.

Although not shown with respect to the systems of FIG. 1*a*, FIG. 1*b*, and FIG. 2, the control valves 54 may be held in a third position similar to the control valve 84 in FIG. 3 such that the control valve 54 and the high-pressure check valves 55, 56 prevent flow of hydraulic fluid between the chamber formed by the first control piston 15, 25, 35, 45 and the chambers formed by the second control piston 18, 28, 38, 48 by way of the high compression ratio line 57 and the low compression ratio line 58 to maintain the current compression position.

Figure 4A:
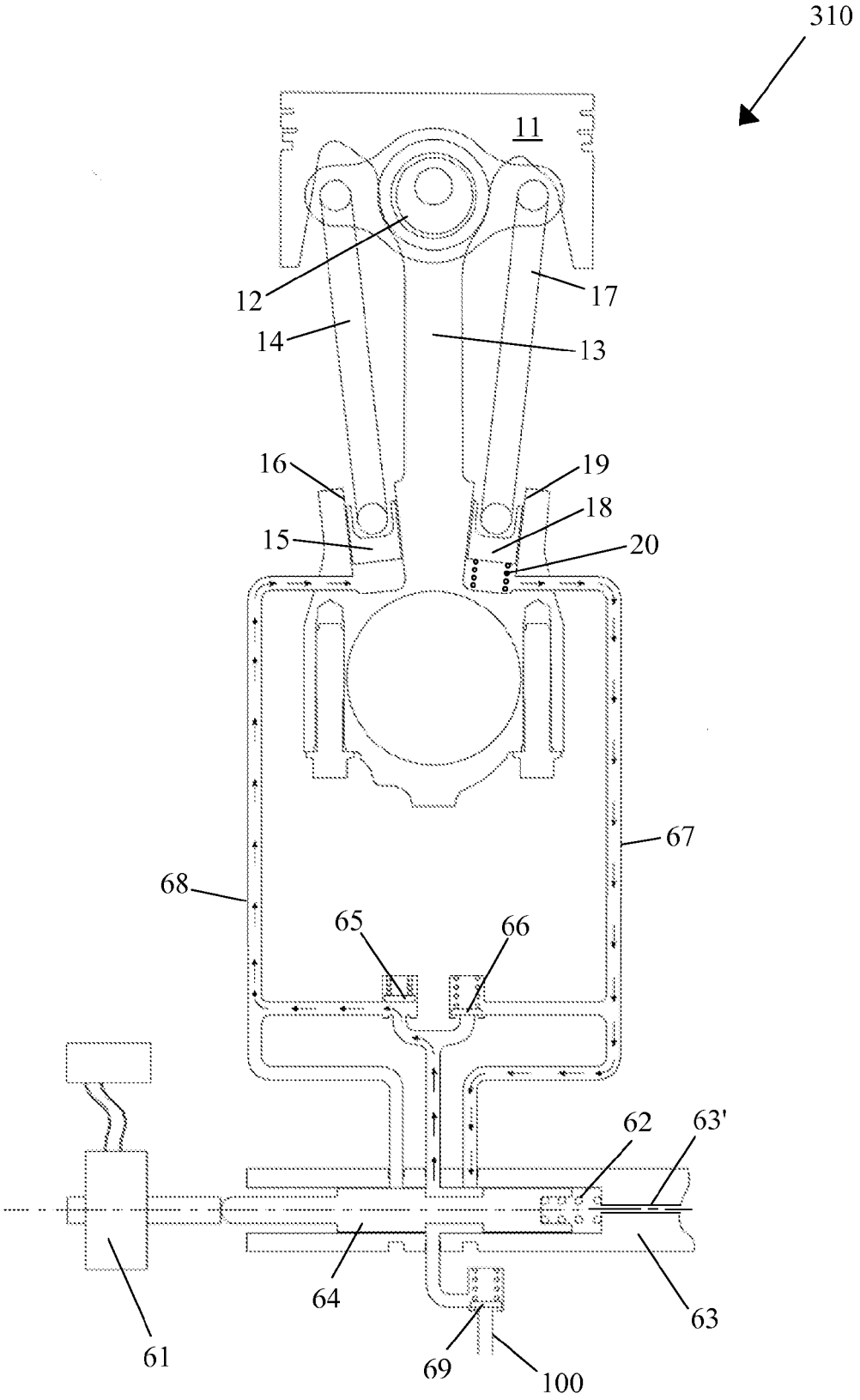
FIG. 4*a* shows a schematic of a variable compression ratio piston with a control system in a first position.
Figure 4B:
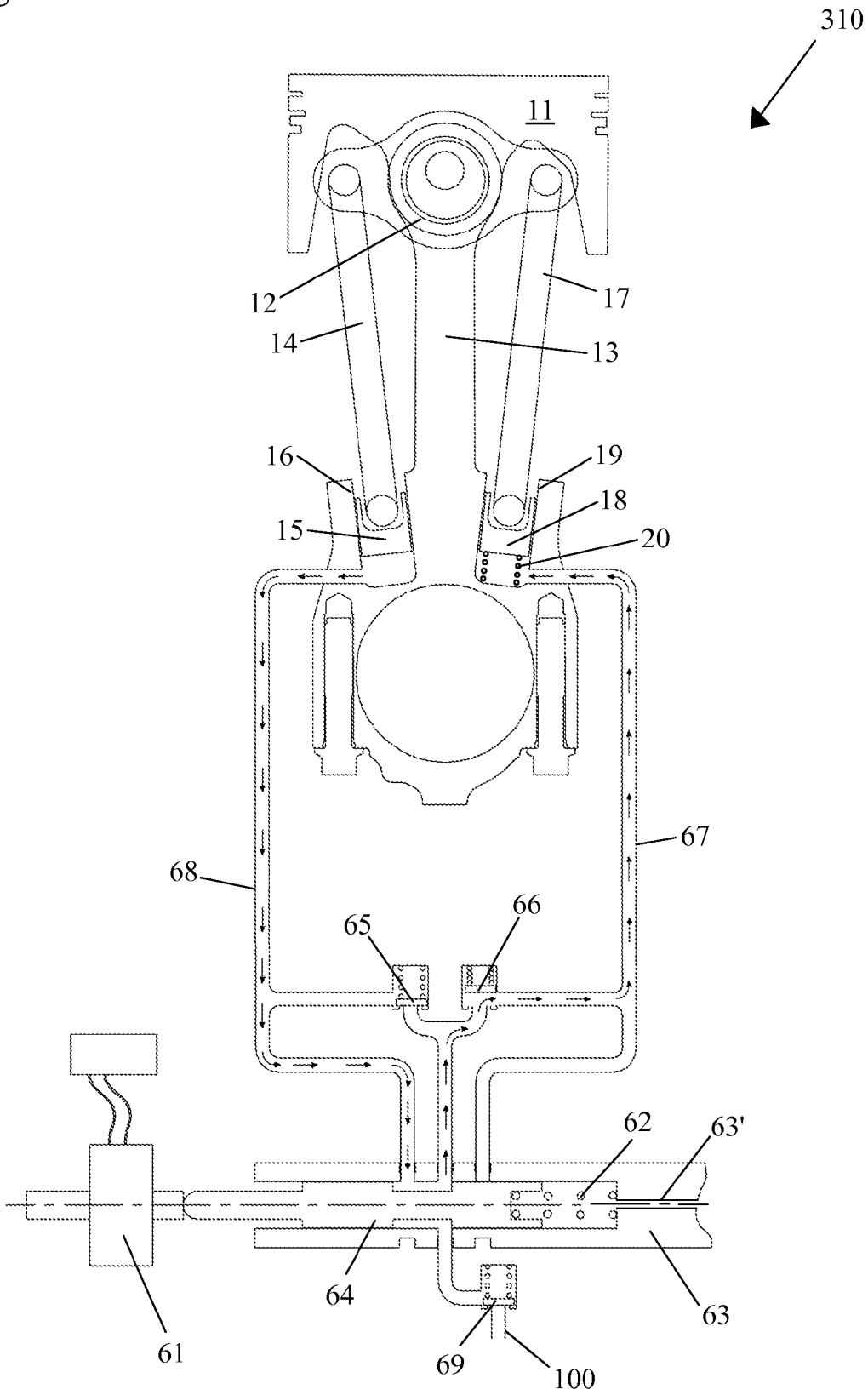
FIG. 4*b* shows a schematic of the piston of FIG. 4*a* with the control system in a second position.
Figure 4C:
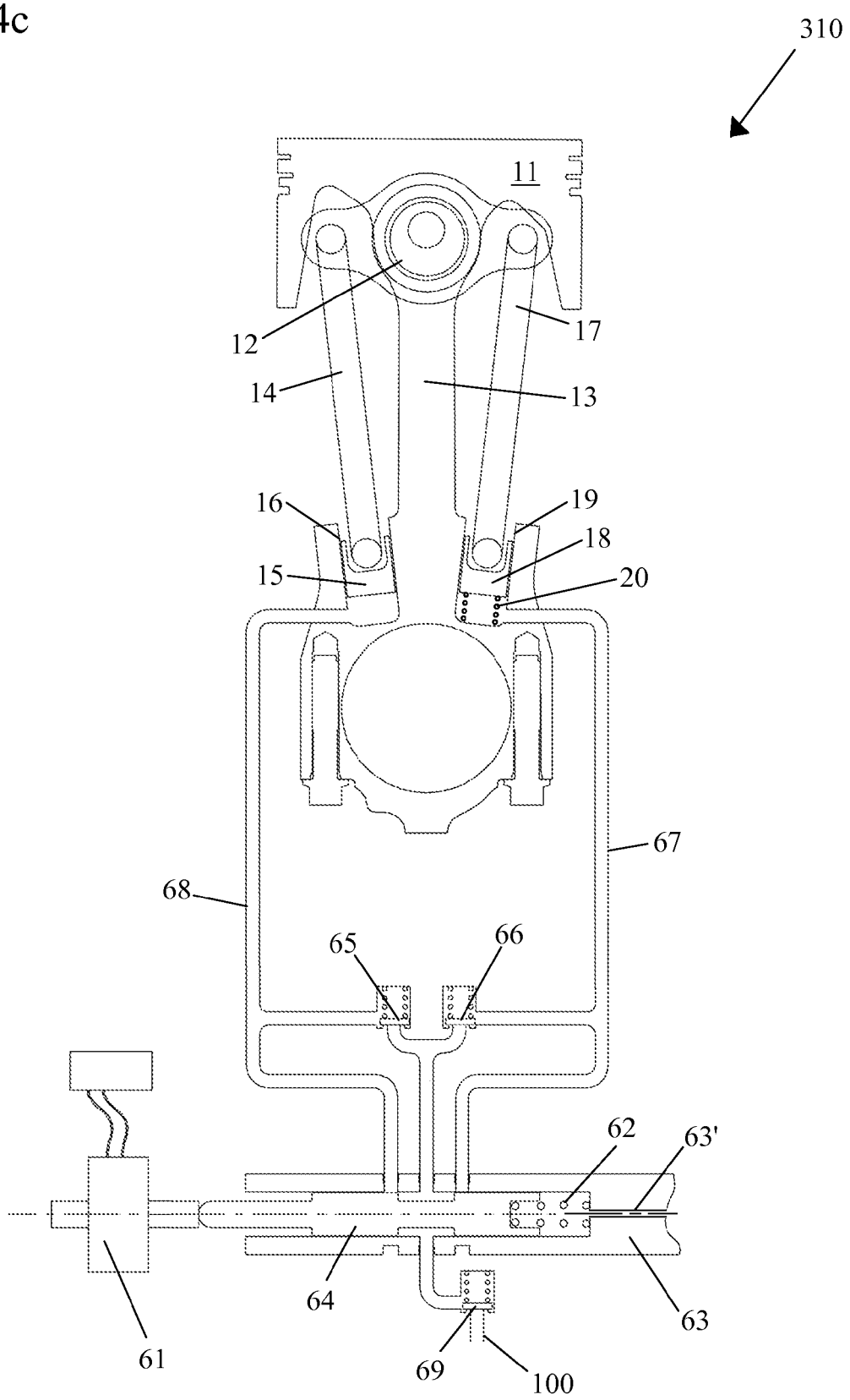
FIG. 4*c* shows a schematic of the piston of FIG. 4*a* with the control system in a third position.

FIG. 4*a*, FIG. 4*b*, and FIG. 4*c* show a single piston system 310 controlled by an individual control system in a first position, a second position, and a third position, respectively. In these systems, the second control piston 18 is biased upward by a control piston bias spring 20. The control piston bias spring 20 on the second control piston 18 biases the engine piston 11 toward a high compression ratio state.

Figure 5C:
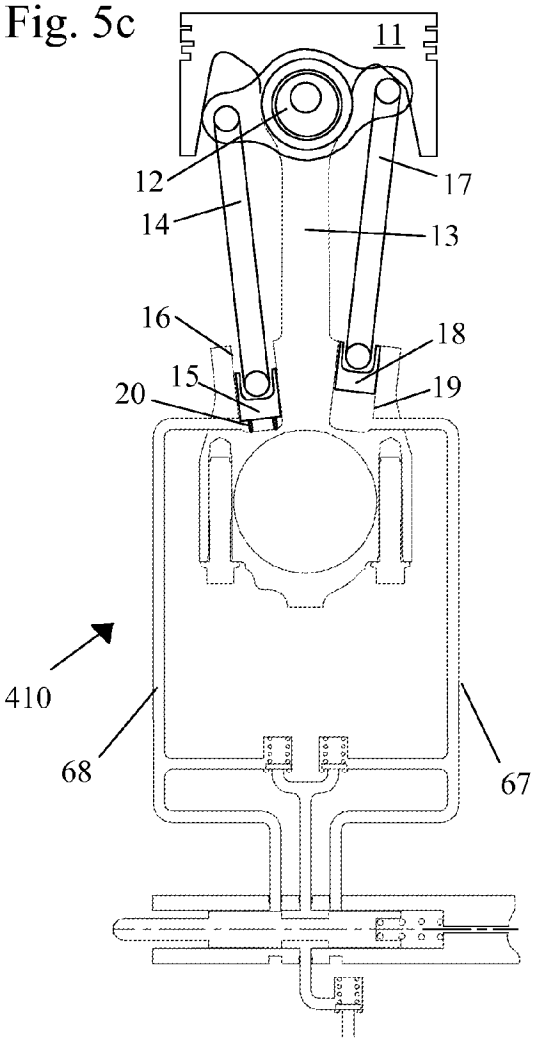
FIG. 5*c* shows a schematic of the piston of FIG. 5*a* in a high compression ratio state.
Figure 5B:
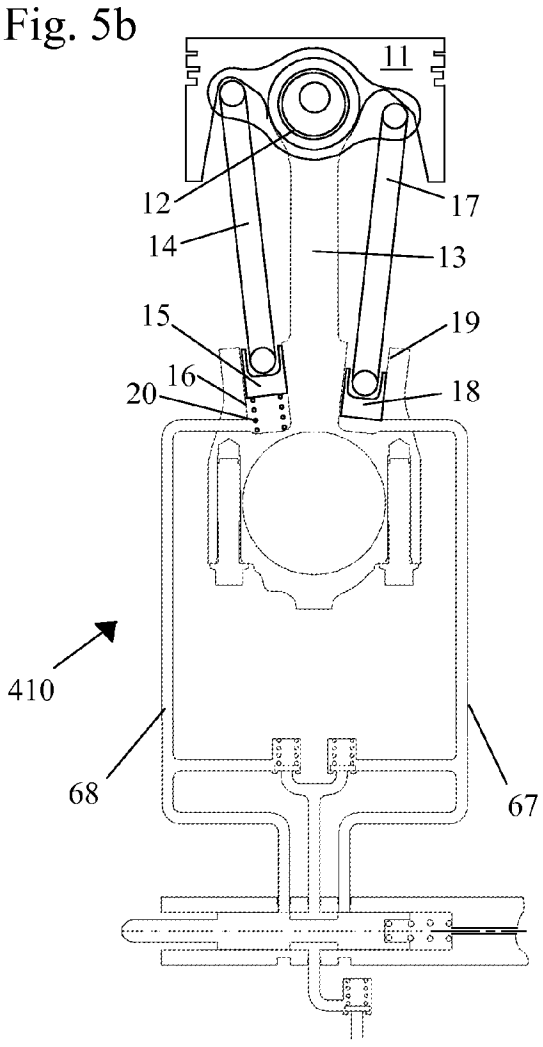
FIG. 5*b* shows a schematic of the piston of FIG. 5*a* in a low compression ratio state.
Figure 5A:
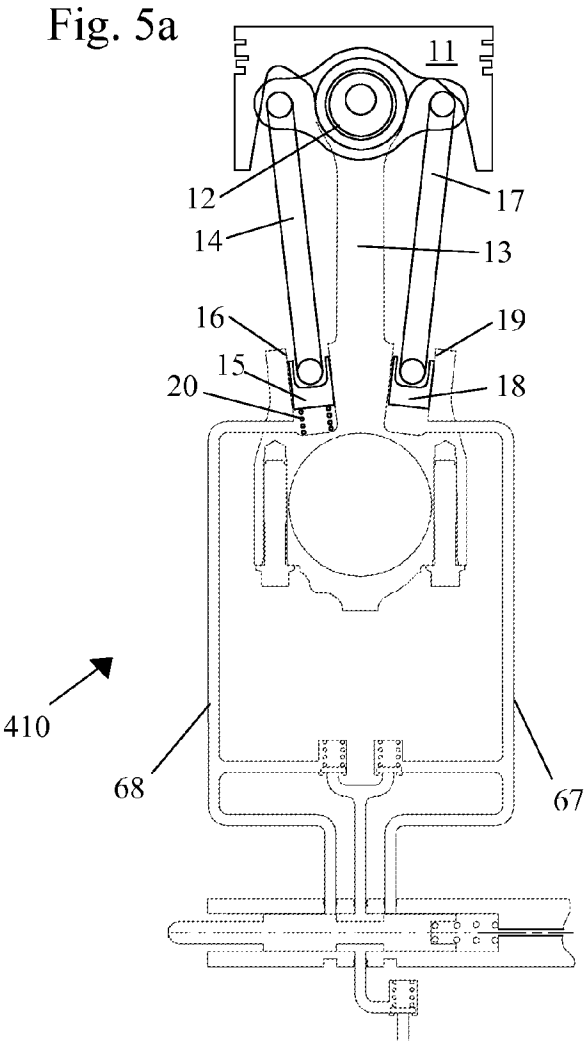
FIG. 5*a* shows a schematic of a piston in an intermediate compression ratio state.

FIG. 5*a*, FIG. 5*b*, and FIG. 5*c* show a single piston system 410 in an intermediate compression ratio state, a low compression ratio state, and a high compression ratio state, respectively, with the individual control system in a third position to prevent flow of hydraulic fluid between the chamber formed by the first control piston 15 and the chamber formed by the second control piston 18 by way of the high compression ratio line 67 and the low compression ratio line 68. The actuator is not shown in FIG. 5*a*, FIG. 5*b*, and FIG. 5*c* for clarity only. In FIG. 5*a* both control pistons 15, 18 are at intermediate positions in their respective control piston bores 16, 19. This positions the engine piston 11 at an intermediate height at top dead center for an intermediate compression ratio state in its cylinder (not shown). In FIG. 5*b*, the first control piston 15 is at a top position in its control piston bore 16, and the second control piston 18 is at a bottom position in its control piston bore 19. This positions the engine piston 11 at a minimum height at top dead center for a low compression ratio state in its cylinder (not shown). In FIG. 5*c*, the first control piston 15 is at a bottom position in its control piston bore 16, and the second control piston 18 is at a top position in its control piston bore 19. This positions the engine piston 11 at a maximum height at top dead center for a high compression ratio state in its cylinder (not shown). In this system, the first control piston 15 is biased upward by a control piston bias spring 20. The control piston bias spring 20 on the first control piston 15 bias the engine piston 11 toward a high compression ratio state.

Although the systems of FIG. 1*a*, FIG. 1*b*, FIG. 2, and FIG. 3 are shown as four-cylinder/four-piston systems and the systems of FIG. 4*a*, FIG. 4*b*, FIG. 4*c*, FIG. 5*a*, FIG. 5*b*, and FIG. 5*c* are shown as one-cylinder/one-piston systems, a variable compression ratio system of the present invention may have any number of cylinders/pistons within the spirit of the present invention. Any of the disclosed systems may have any number of cylinders/pistons, including, but not limited to, one, two, three, four, five, six, and eight.

Although the systems of FIG. 1*a* through FIG. 5*c* are described with a hydraulic control system with a two-land spool controlled by a variable force solenoid as the actuator and a check valve in each of the hydraulic lines, other control systems may be used within the spirit of the present invention. Other actuators include, but are not limited to, a differential pressure control system (DPCS), regulated pressure control system (RPCS), a stepper motor, an air actuator, a vacuum actuator, a hydraulic actuator, or any other type of actuator that has force or position control.

Figure 6:
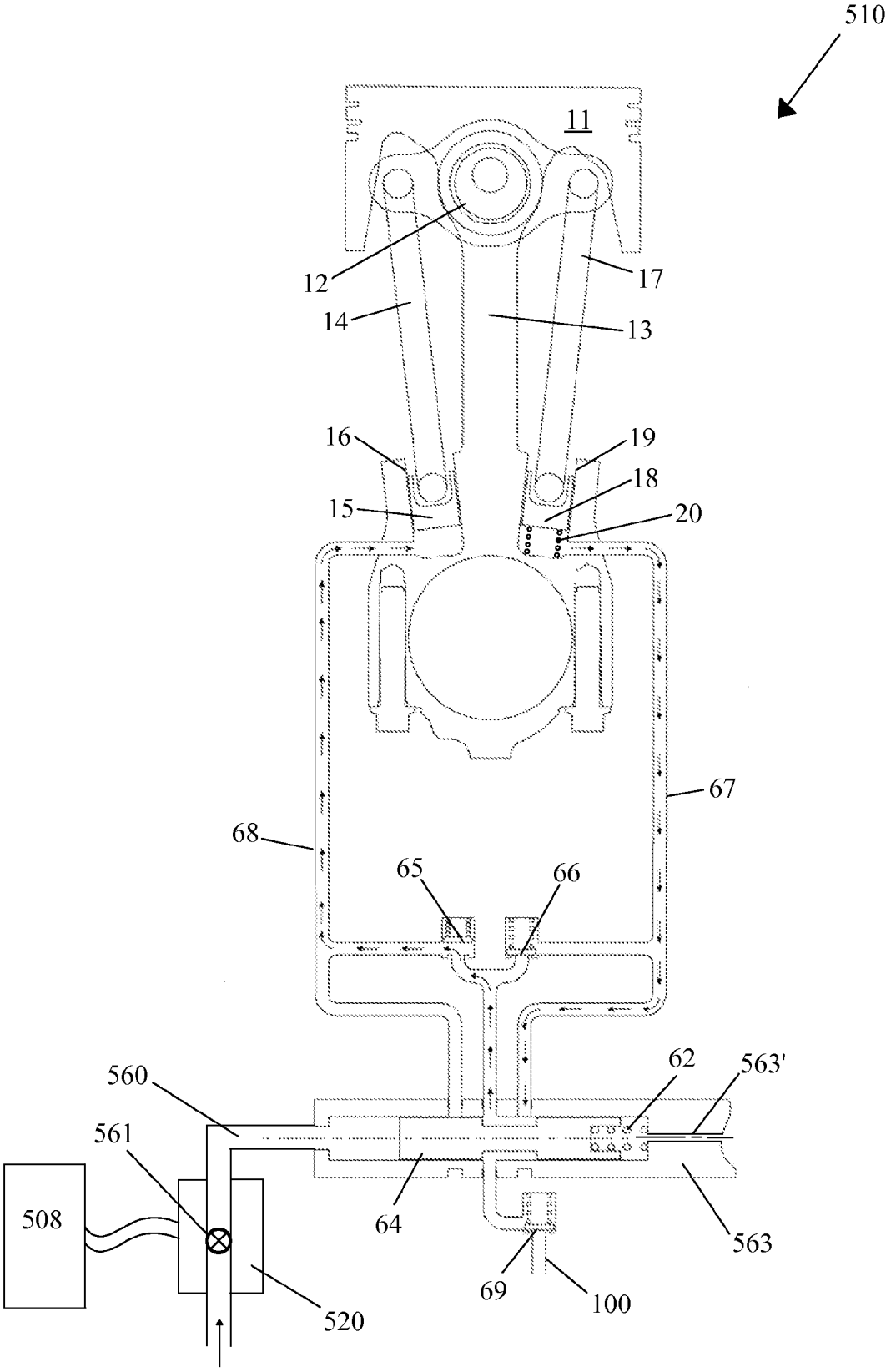
FIG. 6 shows a schematic of the variable compression ratio piston of FIG. 4*a* with a regulated pressure control system (RPCS).

In some embodiments, a regulated pressure control system (RPCS), such as disclosed in U.S. Pat. App. Pub. no. 2008/0135004, entitled "Timing Phaser Control System", by Simpson et al. and published Jun. 12, 2008, hereby incorporated by reference herein, is used. FIG. 6 shows a single piston system 510 controlled by a RPCS 520 with the control valve 563 in a first position. A vent 563' through the control valve body to the atmosphere minimizes air pressure fluctuations in the back end of the spool valve bore when the spool 64 moves back and forth in the spool valve bore. The RPCS 520 receives a signal from a control unit 508, based on a set point, that causes a regulated pressure control valve or a direct control pressure regulator valve 561 to adjust an input oil pressure to a regulated control oil pressure in a biasing channel 560 that biases the end of the spool 64 of the control valve 563, in proportion to the signal and the pressure in the main oil gallery. The other end of the spool 64 of the control valve 563 is preferably biased in the opposite direction by a spring 62. Although a RPCS is shown only in the embodiment of FIG. 7, a RPCS may be used as the valve control system in any of the embodiments disclosed herein.

Figure 7:
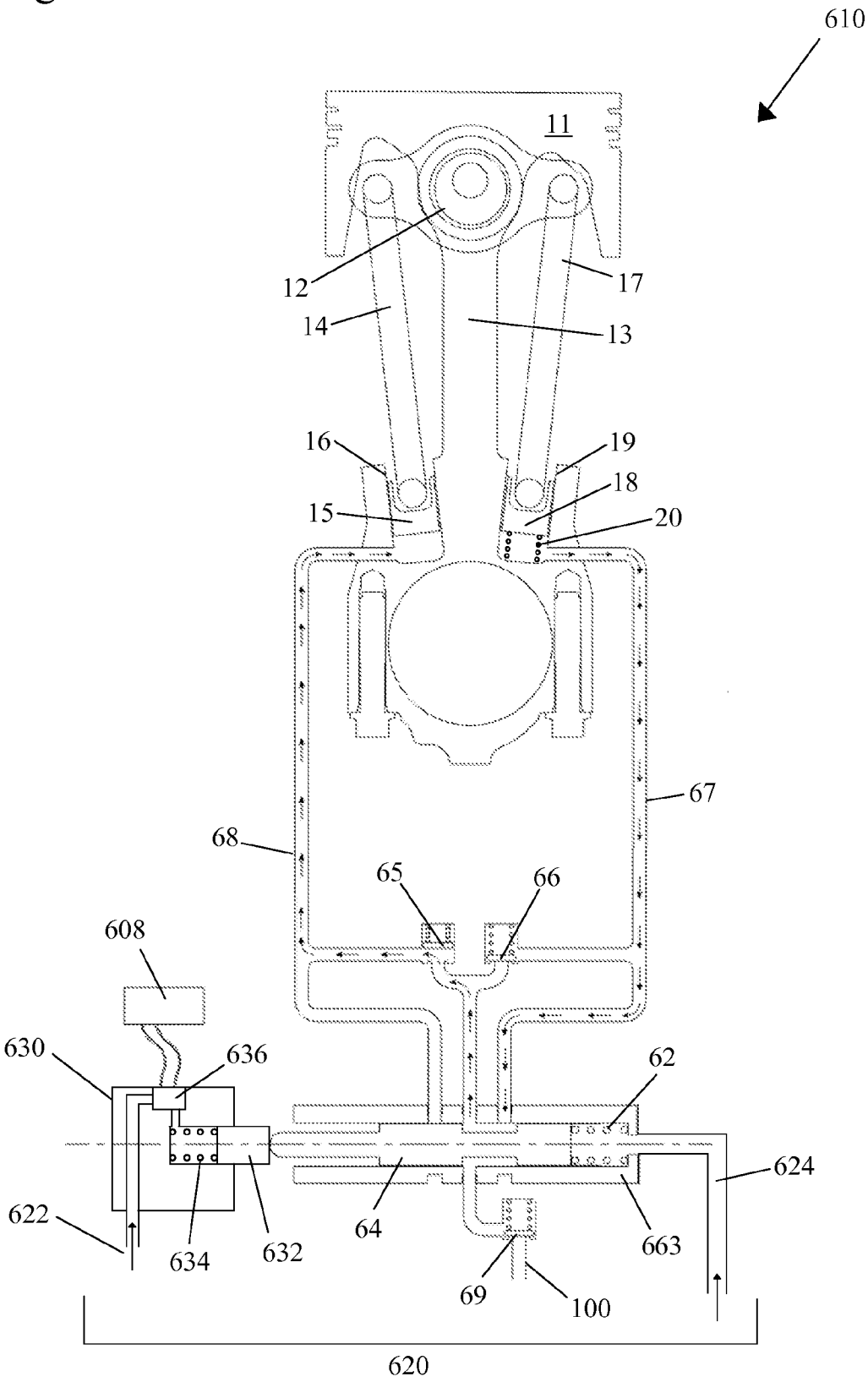
FIG. 7 shows a schematic of the variable compression ratio piston of FIG. 4*a* with a differential pressure control system (DPCS).

In some embodiments, a differential pressure control system (DPCS), such as disclosed in U.S. Pat. No. 6,883,475, entitled "Phaser Mounted DPCS (Differential Pressure Control System) to Reduce Axial Length of the Engine", issued Apr. 26, 2005 to Simpson, hereby incorporated by reference herein, is used. FIG. 7 shows a single piston system 610 controlled by a solenoid DPCS 620 with the control valve 663 in a first position. The position of the spool 64 of the control valve 663 is influenced by the solenoid DPCS 630 that is fed by oil pressure 622 from the engine. The solenoid DPCS 630 is controlled by a control unit 608. The solenoid DPCS 630 utilizes engine oil pressure to control the position of a piston 632 against one end of the spool 64, while oil pressure in a second line 624 opposes the piston 632. The piston 632 is biased toward the spool 64 by a piston spring 634 and the spool 64 is biased toward the piston 632 by a spool spring 62 to maintain contact between the piston 632 and the spool 64 at low oil pressures. The oil pressure in the second line 624 is preferably unregulated engine oil at engine oil pressure but the oil pressure may alternatively be regulated. The solenoid 636 is preferably controlled by an electrical current applied to a coil in response to a control signal, preferably coming directly from the engine control unit 608. Although a DPCS is shown only in the embodiment of FIG. 7, a DPCS may be used as the valve control system in any of the embodiments disclosed herein.

Figure 8:
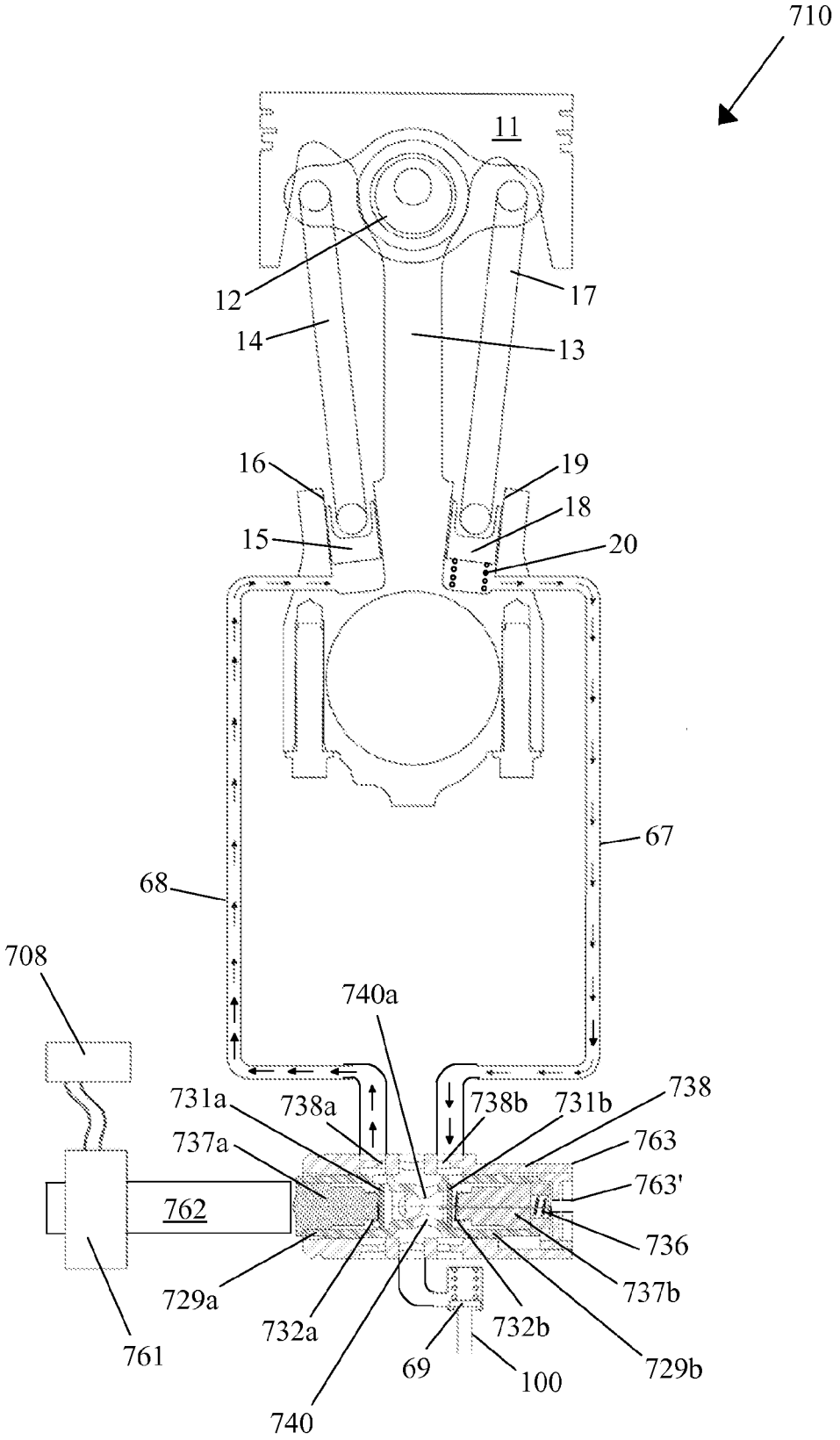
FIG. 8 shows a schematic of the variable compression ratio piston of FIG. 4*a* with a check valve in spool as part of the control system.
Figure 9:
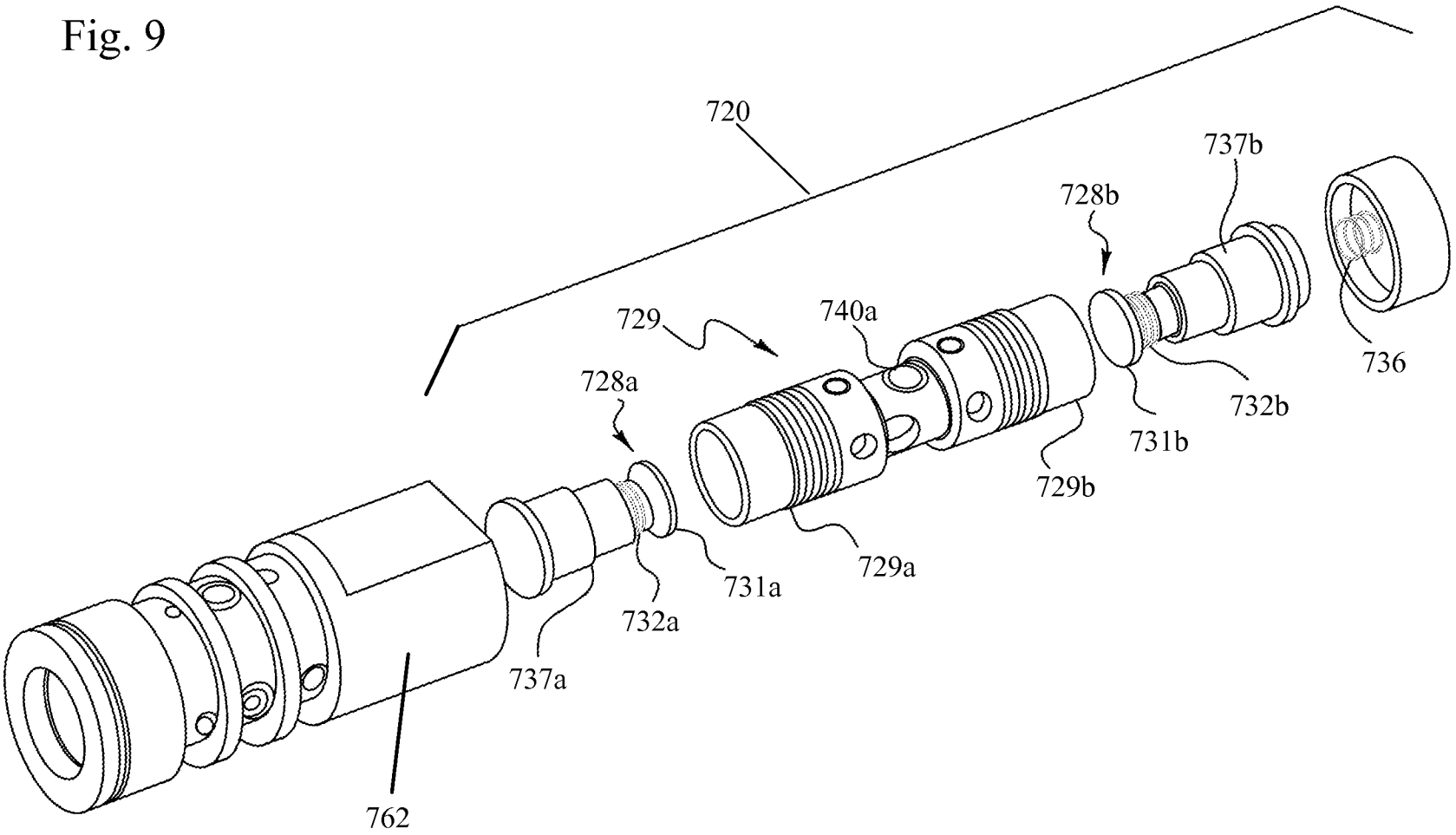
FIG. 9 shows an exploded view of the check valve in spool of FIG. 8.

In some embodiments, a check valve in spool control valve, such as disclosed in PCT patent publication no. WO2012/135179, entitled "Using Torsional Energy to Move an Actuator", by Pluta et al. and published Oct. 4, 2012, hereby incorporated by reference herein, is used. FIG. 8 shows a single piston system 710 with a control valve 763 containing check valves, commonly referred to as a check valve in spool control valve, in place of the control valve shown in the previous figures. A vent 763' through the control valve body to the atmosphere minimizes air pressure fluctuations in the back end of the spool valve bore when the spool 729 moves back and forth in the spool valve bore. The check valves 728*a*, 728*b* are visible in the exploded view of the valve assembly 720 in FIG. 9. The actuator piston 762 is also shown in FIG. 9. Although a check valve in spool is shown only in the embodiment of FIG. 8, a check valve in spool may be used as the control valve in any of the embodiments disclosed herein.

The check valve assembly 720 includes a spool 729 with two lands 729*a* and 729*b* separated by a central spindle 740. Within each of the lands 729*a* and 729*b* are plugs 737*a* and 737*b* that receive the check valves 728*a* and 728*b*. Each check valve 728*a*, 728*b* includes a disk 731*a*, 731*b* and a spring 732*a*, 732*b*. Other types of check valves 728*a*, 728*b* may be used, including, but not limited to, band check valves, ball check valves, and cone-type. The spool 729 is biased outwards from the control shaft by a spring 736. An actuator 761, controlled by a control unit 708, controls the position of the control valve 763. In the position shown, fluid flows from the high compression ratio line 67 to the second port 738*b*, through the central spindle hole 740*a* of the central spindle 740, through the first land 729*a*, through the first check valve 728*a*, and through the first port 738*a* to the low compression ratio line 68. The second check valve 728*b* prevents fluid flow in a reverse direction. The check valves 728*a*, 728*b* obviate the need for a central line 9 and check valves 65, 66 controlling flow between the central line 9 and the high compression ratio line 67 and low compression ratio line 68.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable compression ratio piston system comprising:

at least one engine piston assembly of an engine, each engine piston assembly comprising:

an engine piston slidingly received in an engine cylinder of the engine;

a first control piston mechanically coupled to the engine piston, the first control piston actuating in a first control piston bore, the first control piston and the first control piston bore defining a first chamber;

a second control piston mechanically coupled to the engine piston, the second control piston actuating in a second control piston bore, the second control piston and the second control piston bore defining a second chamber;

a low compression ratio line supplying hydraulic fluid to the first chamber and draining hydraulic fluid from the first chamber; and a high compression ratio line supplying hydraulic fluid to the second chamber and draining hydraulic fluid from the second chamber; and a control system selectively permitting flow of hydraulic fluid between the high compression ratio line and the low compression ratio line comprising:

at least one control valve;

at least one variable force solenoid coupled to the control valve controlling a position of the control valve, an engine control unit controlling an energization state of the variable force solenoid;

a first check valve permitting flow of hydraulic fluid to the high compression ratio line but preventing flow of hydraulic fluid from the high compression ratio line;

a second check valve permitting flow of hydraulic fluid to the low compression ratio line but preventing flow of hydraulic fluid from the low compression ratio line; and a central line permitting flow of hydraulic fluid from the control valve to the first check valve and the second check valve;

wherein, when the control valve is in a first position, a first net flow of hydraulic fluid from the second chamber to the first chamber by way of the high compression line, the control valve, and the low compression line is permitted such that the first net flow raises the first control piston in the first control piston bore and lowers the second control piston in the second control bore to lower the engine piston, thereby decreasing a compression ratio of the engine piston toward a low compression ratio state; and wherein, when the control valve is in a second position, a second net flow of hydraulic fluid from the first chamber to the second chamber by way of the low compression line, the control valve, and the high compression line is permitted such that the second net flow raises the second control piston in the second control piston bore and lowers the first control piston in the first control bore to raise the engine piston, thereby increasing the compression ratio of the engine piston toward a high compression ratio state.

2. The variable compression ratio piston system of claim 1, wherein, when the control valve is in a third position, the control system prevent flow of hydraulic fluid between the first chamber and the second chamber by way of the high compression line, the control valve, and the low compression line, thereby maintaining the compression ratio of the engine piston.

3. The variable compression ratio piston system of claim 1, wherein the control valve further comprises:

a control valve body receiving hydraulic fluid from a hydraulic fluid source and having a control valve bore;

a spool slidingly received in the control valve bore and comprising a first land and a second land; and a control valve spring biasing the spool outward from the control valve bore.

4. The variable compression ratio piston system of claim 3, wherein, when the control valve is in the first position, the first land blocks flow of hydraulic fluid from the low compression ratio line to the central line such that a net flow of hydraulic fluid from the second chamber to the first chamber by way of the high compression fluid line to the control valve to the central line to the first check valve to the low compression ratio line raises the first control piston in the first control piston bore and lowers the second control piston in the second control bore to lower the engine piston, thereby decreasing the compression ratio of the engine piston toward the low compression ratio state.

5. The variable compression ratio piston system of claim 3, wherein, when the control valve is in the second position, the second land blocks flow of hydraulic fluid from the high compression ratio line to the central line such that a net flow of hydraulic fluid from the first chamber to the second chamber by way of the low compression fluid line to the control valve to the central line to the second check valve to the high compression ratio line raises the second control piston in the second control piston bore and lowers the first control piston in the first control bore to raise the engine piston, thereby increasing the compression ratio of the engine piston toward the high compression ratio state.

6. The variable compression ratio piston system of claim 3, wherein, when the control valve is in a third position, the first land and the first check valve block flow of hydraulic fluid from the low compression ratio line and the second land and the second check valve block flow of hydraulic fluid from the high compression ratio line to the central line, thereby preventing flow from the first chamber and the second chamber to maintain the compression ratio of the engine piston.

7. The variable compression ratio piston system of claim 3 further comprising an inlet check valve located between the control valve and the hydraulic fluid source permitting flow of hydraulic fluid from the hydraulic fluid source to the control valve but preventing flow of hydraulic fluid from the control valve to the hydraulic fluid source.

8. The variable compression ratio piston system of claim 1 further comprising a control piston bias spring located in the first chamber to bias the variable compression ratio piston system toward the low compression ratio state.

9. The variable compression ratio piston system of claim 1 further comprising a control piston bias spring located in the second chamber to bias the variable compression ratio piston system toward the high compression ratio state.

10. The variable compression ratio piston system of claim 1, wherein the at least one engine piston assembly comprises a plurality of engine piston assemblies.

11. The variable compression ratio piston system of claim 10, wherein the at least one control valve comprises a single control valve.

12. The variable compression ratio piston system of claim 10, wherein the at least one control valve comprises a plurality of control valves equal in number to the plurality of engine piston assemblies, each engine piston being controlled by one of the plurality of control valves.

13. The variable compression ratio piston system of claim 1, wherein each engine piston assembly further comprises:

a connecting rod having the first control piston bore and the second piston bore;

an eccentric bearing coupling the connecting rod to the engine piston;

a first linking rod coupling the first control piston to the eccentric bearing; and a second linking rod coupling the first control piston to the eccentric bearing.

14. The variable compression ratio piston system of claim 1, wherein flow of hydraulic fluid is actuated by alternating forces from inertial and combustion forces on a crankshaft from operation of the engine.

15. The variable compression ratio piston system of claim 1, wherein the actuator is a regulated pressure control system.

16. The variable compression ratio piston system of claim 1, wherein the actuator is a differential pressure control system.

17. The variable compression ratio piston system of claim 1, wherein the control valve further comprises:

a control valve body receiving hydraulic fluid from a hydraulic fluid source and having a control valve bore;

a spool slidingly received in the control valve bore, the spool comprising a first land and a second land and having a first plug in a first end of the spool and a second plug in a second end of the spool opposite the first end;

a first check valve received in the first plug of the spool;

a second check valve received in the second plug of the spool; and a control valve spring biasing the spool outward from the control valve bore.

18. A method of varying a compression ratio of at least one engine piston received in an engine cylinder of an engine in a variable compression ratio piston system further comprising a first control piston mechanically coupled to the engine piston, the first control piston actuating in a first control piston bore, the first control piston and the first control piston bore defining a first chamber, a second control piston mechanically coupled to the engine piston, the second control piston actuating in a second control piston bore, the second control piston and the second control piston bore defining a second chamber, a low compression ratio line supplying hydraulic fluid to the first chamber and draining hydraulic fluid from the first chamber, a high compression ratio line supplying hydraulic fluid to the second chamber and draining hydraulic fluid from the second chamber, and a control system selectively permitting flow of hydraulic fluid between the low compression ratio line and the high compression ratio line, the control system comprising at least one control valve; a variable force solenoid coupled to the control valve; an engine control unit controlling an energization state of the variable force solenoid; a first check valve permitting flow of hydraulic fluid to the high compression ratio line but preventing flow of hydraulic fluid from the high compression ratio line; a second check valve permitting flow of hydraulic fluid to the low compression ratio line but preventing flow of hydraulic fluid from the low compression ratio line; and a central line permitting flow of hydraulic fluid from the control valve to the first check valve and the second check valve, the method comprising the steps of:

a) measuring a load on the engine;

b) calculating a compression ratio state for the at least one engine piston based on the load on the engine;

c) adjusting the control valve to permit the variable compression ratio piston system to move toward the compression ratio state; and d) adjusting the control valve to a third position when the variable compression ratio piston system reaches the compression ratio state;

wherein, when the control valve is in a first position, a first net flow of hydraulic fluid from the second chamber to the first chamber by way of the high compression line, the control valve, and the low compression line is permitted such that the first net flow raises the first control piston in the first control piston bore and lowers the second control piston in the second control bore to lower the engine piston, thereby decreasing a compression ratio of the engine piston toward a low compression ratio state;

wherein, when the control valve is in a second position, a second net flow of hydraulic fluid from the first chamber to the second chamber by way of the low compression line, the control valve, and the high compression line is permitted such that the second net flow raises the second control piston in the second control piston bore and lowers the first control piston in the first control bore to raise the engine piston, thereby increasing the compression ratio of the engine piston toward a high compression ratio state; and wherein, when the control valve is in a third position, the control system prevents flow of hydraulic fluid between the first chamber and the second chamber by way of the low compression line, the control valve, and the high compression line, thereby maintaining the compression ratio of the engine piston.

19. The method of claim 18, wherein step c) comprises a substep of energizing a variable force solenoid to adjust the position of the control valve.

20. The method of claim 18, wherein flow of hydraulic fluid is actuated by alternating forces from inertial and combustion forces on a crankshaft from operation of the engine.

21. A variable compression ratio piston system comprising:

at least one engine piston assembly of an engine, each engine piston assembly comprising:

an engine piston slidingly received in an engine cylinder of the engine;

a first control piston mechanically coupled to the engine piston, the first control piston actuating in a first control piston bore, the first control piston and the first control piston bore defining a first chamber;

a second control piston mechanically coupled to the engine piston, the second control piston actuating in a second control piston bore, the second control piston and the second control piston bore defining a second chamber;

a control piston bias spring located in the second chamber to bias the variable compression ratio piston system toward the high compression ratio state;

a low compression ratio line supplying hydraulic fluid to the first chamber and draining hydraulic fluid from the first chamber; and a high compression ratio line supplying hydraulic fluid to the second chamber and draining hydraulic fluid from the second chamber; and a control system comprising at least one control valve and at least one actuator controlling a position of the control valve, the control system selectively permitting flow of hydraulic fluid between the high compression ratio line and the low compression ratio line;

wherein, when the control valve is in a first position, a first net flow of hydraulic fluid from the second chamber to the first chamber by way of the high compression line, the control valve, and the low compression line is permitted such that the first net flow raises the first control piston in the first control piston bore and lowers the second control piston in the second control bore to lower the engine piston, thereby decreasing a compression ratio of the engine piston toward a low compression ratio state; and wherein, when the control valve is in a second position, a second net flow of hydraulic fluid from the first chamber to the second chamber by way of the low compression line, the control valve, and the high compression line is permitted such that the second net flow raises the second control piston in the second control piston bore and lowers the first control piston in the first control bore to raise the engine piston, thereby increasing the compression ratio of the engine piston toward a high compression ratio state.

22. The variable compression ration piston system of claim 21, wherein the actuator is a variable force solenoid coupled to the control valve, the control system further comprising:

an engine control unit controlling an energization state of the variable force solenoid;

a first check valve permitting flow of hydraulic fluid to the high compression ratio line but preventing flow of hydraulic fluid from the high compression ratio line;

a second check valve permitting flow of hydraulic fluid to the low compression ratio line but preventing flow of hydraulic fluid from the low compression ratio line; and a central line permitting flow of hydraulic fluid from the control valve to the first check valve and the second check valve.

23. The variable compression ratio piston system of claim 21, wherein the control valve further comprises:

a control valve body receiving hydraulic fluid from a hydraulic fluid source and having a control valve bore;

a spool slidingly received in the control valve bore and comprising a first land and a second land; and a control valve spring biasing the spool outward from the control valve bore.

* * * * *